United States Patent [19]

Wydra et al.

[11] Patent Number: 4,735,560

[45] Date of Patent: Apr. 5, 1988

[54] SEAL ASSEMBLY FOR A ROTARY DEVICE

[76] Inventors: Larry Wydra, 1408 Yorkshire Ave. S., Minnetonka, Minn. 55343; Ralph Hoffmann, 15950 Hillcrest Ct., Eden Prairie, Minn. 55343

[21] Appl. No.: 18,409

[22] Filed: Feb. 25, 1987

[51] Int. Cl.[4] ..... F01C 19/08; F01C 1/10

[52] U.S. Cl. ..... 418/61 B; 418/144; 277/81 P

[58] Field of Search ..... 418/61 B, 144; 277/81 P, 81 R, 190; 418/142

[56] References Cited

U.S. PATENT DOCUMENTS

| | | | |
|---|---|---|---|
| 3,064,880 | 11/1962 | Wankel et al. | 418/124 |
| 3,120,921 | 2/1964 | Hovorka | 418/111 |
| 3,193,186 | 7/1965 | Peras | 418/61 R |
| 3,226,013 | 12/1965 | Toyoda et al. | 418/61 R |
| 3,253,581 | 5/1966 | Nallinger | 418/117 |
| 3,270,954 | 9/1966 | Yamamoto | 418/61 R |
| 3,280,801 | 10/1966 | Scherenberg | 418/117 |
| 3,284,087 | 11/1966 | Luck | 277/58 |
| 3,295,505 | 1/1967 | Jordan | 123/241 |
| 3,410,255 | 11/1968 | Winkelmann et al. | 60/282 |
| 3,685,922 | 8/1972 | Lamm | 418/113 |
| 3,768,936 | 10/1973 | McCormick | 418/142 |
| 3,844,692 | 10/1974 | McLain | 418/113 |
| 3,857,656 | 12/1974 | Ishikawa | 418/120 |
| 3,937,603 | 2/1976 | Kopich et al. | 418/117 |
| 3,973,882 | 8/1976 | Winchell | 418/121 |
| 3,995,599 | 12/1976 | Shier | 123/8.05 |
| 4,138,124 | 2/1979 | Kurio | 418/144 |
| 4,207,039 | 6/1980 | Eiermann | 418/77 |
| 4,319,867 | 3/1982 | Koshelev et al. | 418/113 |

FOREIGN PATENT DOCUMENTS

| | | | |
|---|---|---|---|
| 1072769 | 12/1959 | Fed. Rep. of Germany . | |
| 1200081 | 9/1965 | Fed. Rep. of Germany . | |
| 1301328 | 8/1969 | Fed. Rep. of Germany . | |
| 2210555 | 9/1973 | Fed. Rep. of Germany | 418/144 |
| 2550032 | 5/1977 | Fed. Rep. of Germany . | |

*Primary Examiner*—John J. Vrablik
*Assistant Examiner*—Leonard P. Walnoha
*Attorney, Agent, or Firm*—Hill, Van Santen, Steadman & Simpson

[57] ABSTRACT

A seal assembly for an outer envelope trochoidal rotary device having a rotor that planetates around a housing is provided. The seal arrangement comprises a series of side seals disposed in side walls in the housing, the side seals being interconnected by button seals disposed in the side walls of the housing between side seals. The side seals and button seals are spring biased outwardly against the rotor. Each side seal includes a pair of identical oppositely disposed seal strips having an elongated body member and a triangular portion. The elongated body member includes a triangularly shaped relieved portion that has a shape corresponding to a side of the triangular portion. The seal strips are interconnected between two button seals so that the triangular portion of a first seal strip abuts a first button seal and the triangular portion of a second seal strip abuts a second button seal. The button seal includes a relieved area.

16 Claims, 2 Drawing Sheets

SEAL ASSEMBLY FOR A ROTARY DEVICE

BACKGROUND OF THE INVENTION

This invention relates generally to rotary devices. More specifically, this invention relates to outer envelope trochoidal rotary devices.

Trochoidal rotary devices are constructed so that a rotor assembly planetarily rotates in a housing defining a cavity. Trochoidal rotary devices can be divided into two groups: inner envelope trochoidal devices; and outer envelope trochoidal devices. In an inner envelope trochoidal device, the rotor assembly includes apex seals, side seals, and button seals that cooperate with the inner walls of the housing that define the cavity to define a plurality of discrete chambers. In an outer envelope trochoidal device, the apex seals, side seals, and button seals are mounted in the inner wall of the housing, the apex seal being mounted between the individual working chambers. Accordingly, the peripheral surface of the rotor assembly cooperates with the apex seal to define a plurality of discrete chambers. The peripheral surface of the rotor assembly and inner wall of the housing function as working chambers for expansion engines, compressors, expanders, meters, etc.

The side seals cooperate with the button seals to seal the rotor and the housing between the sides thereof. In an internal combustion engine this is important to prevent gas leakage from the working chambers. The side seals also cooperate to prevent oil leakage from the rotor shaft into the working chambers. The button seals function to complete the seal grid on the housing between the rotor and side wall of the housing; to this end, the button seals cooperate with the apex seals to provide a seal for the working chambers.

In order to afford a tight seal, the button seals are biased against the rotor. To create a sufficiently strong seal grid, a given pressure (i.e., pounds per square inch) must be exerted by the button seal against the apex seal and rotor. A certain force is required to counteract any lifting which could occur if gas pressure gets under the seal. The spring force exerted by the button seals must equal or exceed the potential gas force in case the seal lifts off the contact surface of the rotor. Accordingly, the larger the surface area of the button seal that abuts the rotor, the larger the force exerted by the button seal against the rotor. This results in a corresponding frictional drag against the rotor and therefore a corresponding loss in the efficiency of the trochoidal device.

For example, in an outer envelope trochoidal device having a trochoidal rotor having four lobes, the cavity of the housing defines the outer envelope of that trochoidal curve and accordingly has five concave portions. Therefore, five apex seals are disposed at the intersection of each of the concave portions. Because, a button seal must be located at each end of the apex seal, ten (10) button seals are located in such a trochoidal rotary device. As can be appreciated, because there are ten button seals, each incremental frictional drag force exerted by each button seal can result in a large frictional drag force on the rotor. Therefore, it is desireable to reduce the frictional drag of the button seals on the rotor assembly.

The side seals also provide a concern in some typical prior rotary devices. For example, some prior rotary devices have side seals that do not seal the side of the housing and rotor sufficiently tight and, accordingly, oil leaks into the working chambers. To counteract this problem, cut off a portion of the side seal and insert a filler piece in the gap. The filler piece extends from the remaining portions of the seal and contacts the rotor; the intent being that as the extended end is worn off a continuous seal along the length of the grid is effected. However, as the rotor heats up and cools, the filler piece slides up and down causing the filler piece to move within the gap and separate from the remaining portions of the seal. This results in a leak in the seal. Therefore, this side seal arrangement has not been entirely satisfactory.

Accordingly, there is a need for an improved seal arrangement for an outer envelope trochoidal device.

SUMMARY OF THE INVENTION

The present invention provides a seal assembly for an outer envelope trochoidal rotary device having a rotor that planetates around a housing. The seal arrangement comprises a series of side seals disposed in side walls in the housing, the side seals being interconnected by button seals disposed in the side walls of the housing between side seals. The side seals and button seals are spring biased outwardly against the rotor. Each side seal includes a pair of identical oppositely disposed seal strips having an elongated body member and a triangular portion. The elongated body member includes a triangularly shaped relieved portion that has a shape corresponding to a side of the triangular portion. The seal strips are interconnected between two button seals so that the triangular portion of one seal strip abuts a first button seal and the triangular portion of a second seal strip abuts a second button seal. The button seals include a relieved area.

Preferably, the triangular portion includes a relieved portion, the relieved portion defining a gap between the button seal, main body portion, and rotor. Preferably, the body portion includes a plurality of indentations, the seal strips being disposed oppositely so that the indentations of one seal strip do not overlap with the indentations of a second seal strip.

The present invention also provides an improved button seal. The button seal has a circular cross-sectional profile that includes a relieved area. By relieving a portion of the area of the button seal that contacts the rotor, the spring force exerted against the button seal can be reduced.

In one embodiment of the button seal, the relieved area of the button seal comprises an 80° circular arc. In another embodiment of the button seal, the relieved area comprises a swath area. In both embodiments, the area relieved is on the rotor side of the button seal, i.e., the side of the button seal that contacts the rotor.

DETAILED DESCRIPTION OF THE PRESENTLY PREFERRED EMBODIMENTS

Figure 1:
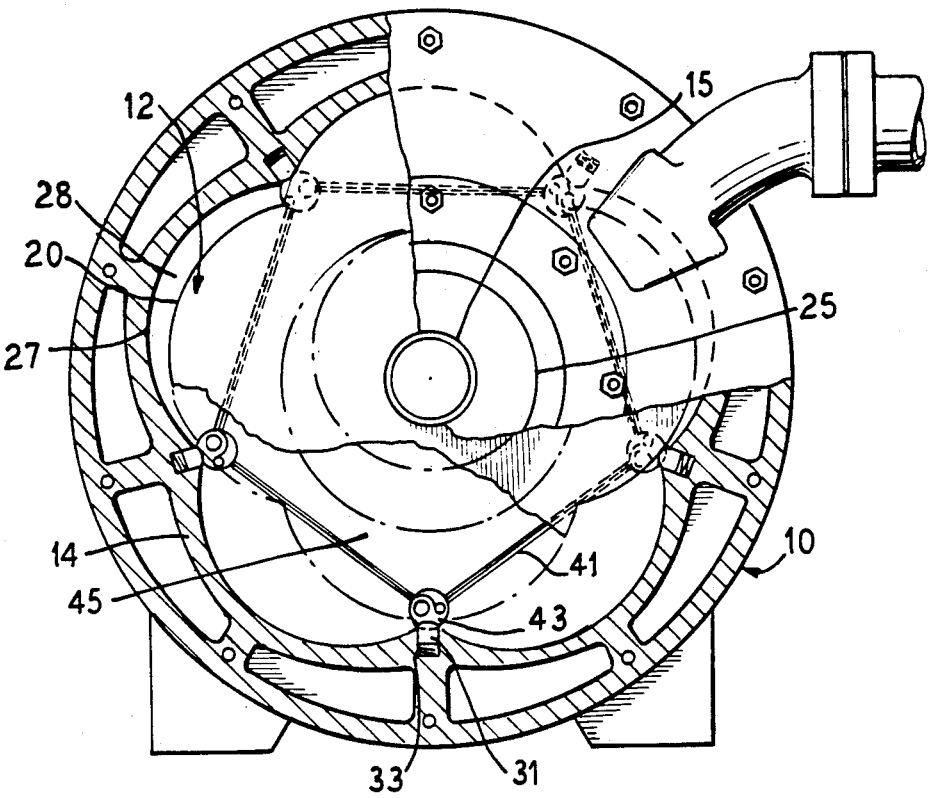
FIG. 1 illustrates a perspective view with parts broken away of a rotary device of this invention.

Referring to FIG. 1, the outer envelope trochoidal device 10 of the present invention is illustrated. As used herein the term trochoidal device refers to devices that have modified trochoidal curves or, for example, use a curve parallel to a trochiodal curve. The trochoidal device 10 includes a rotor 12, a housing 14, and a rotary shaft 15. The rotor 12 moves in a planetating fashion about a shaft 15 within the housing 14 over an eccentric lobe 25 connected to the shaft. The rotor 12 is rotatably mounted over the eccentric via an angular sleeve bearing. The trochoidal rotary device 10 uses the space formed between the peripheral wall surface 27 of the housing 14 and the peripheral surface 20 of the rotor 12 to define fluid working spaces 28 for engines, compressors, expanders, meters, etc.

A trochoidal rotary device can also be constructed so that the rotor is eccentrically mounted from the housing and rotated together.

As illustrated, the trochoidal rotary device 10 is an outer envelope trochoidal rotary device having apex seals 31 located in slots 33 in the peripheral wall surface 27 of the housing 14. The radially extending apex seals 31 function to provide a means for sealing the working chambers 28 across the peripheral wall of the housing 14. Accordingly, the rotor 12 and apex seals 31 cooperate to define working chambers 28 in the rotary device.

As discussed in greater detail below, located in slots 35 in the side walls 37 of the housing 14 are side seals 41. Also disposed in the side walls 37 of the housing 14 are button seals 43. The button seals 43 and side walls 37 cooperate to limit the flow of fluid from the area 45 internal of the seals to and from the area of the working chambers 28. To this end, a series of side seals 41 are located between a plurality of button seals 43 to define a seal grid assembly. As discussed below, the button seals 43 and side seals 41 are biased by springs 49 and 47 respectively, outwardly away from the side walls 37 of the housing 14 against the rotor 12. For example, in an internal combustion chamber the button seals 43 and side seals 41 define a seal grid that functions to limit the flow of gasoline from the working chambers 28 into the internal area 45 of the rotor 12; and the seals function to prevent the flow of oil from the internal area 45 of the rotor to the working chambers 28.

Figure 2:
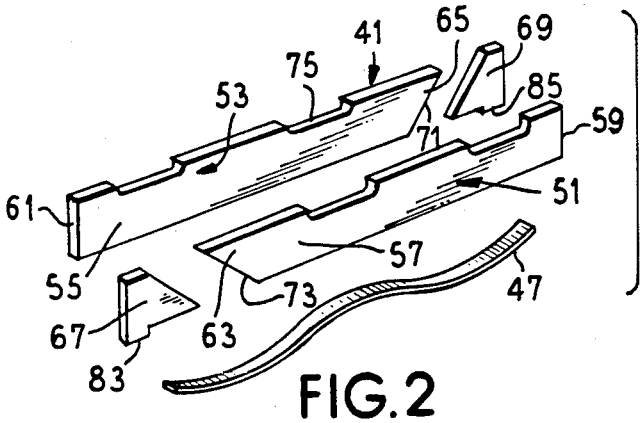
FIG. 2 illustrates an exploded view of the side seal of the present invention.
Figure 3:
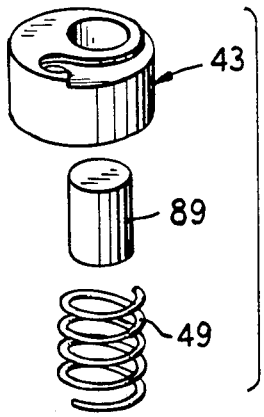
FIG. 3 illustrates an exploded view of an embodiment of the button seal of the present invention.
Figure 4:
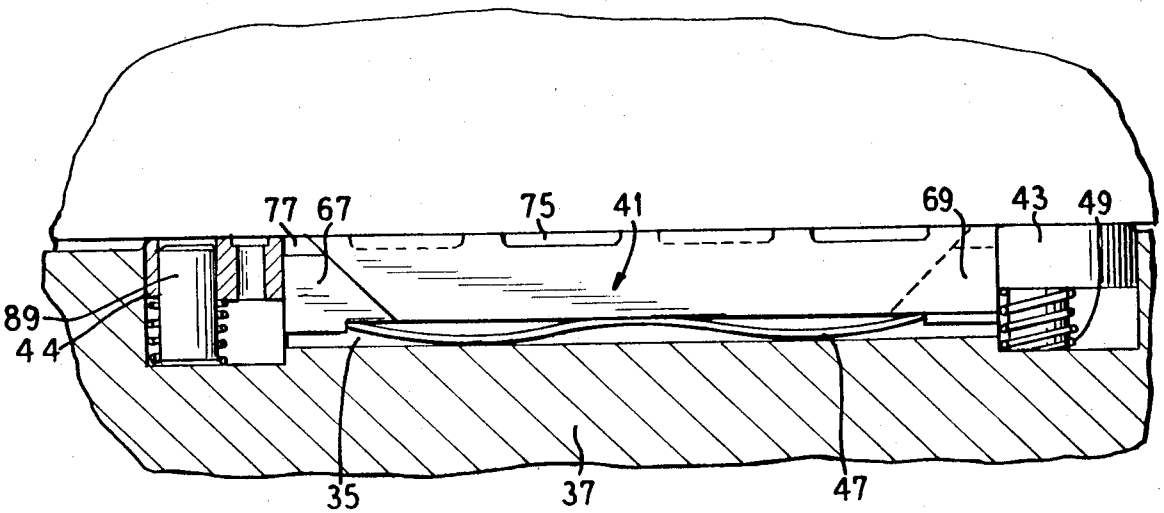
FIG. 4 illustrates a cross-sectional view of the side seals and button seals of the present invention.
Figure 5:
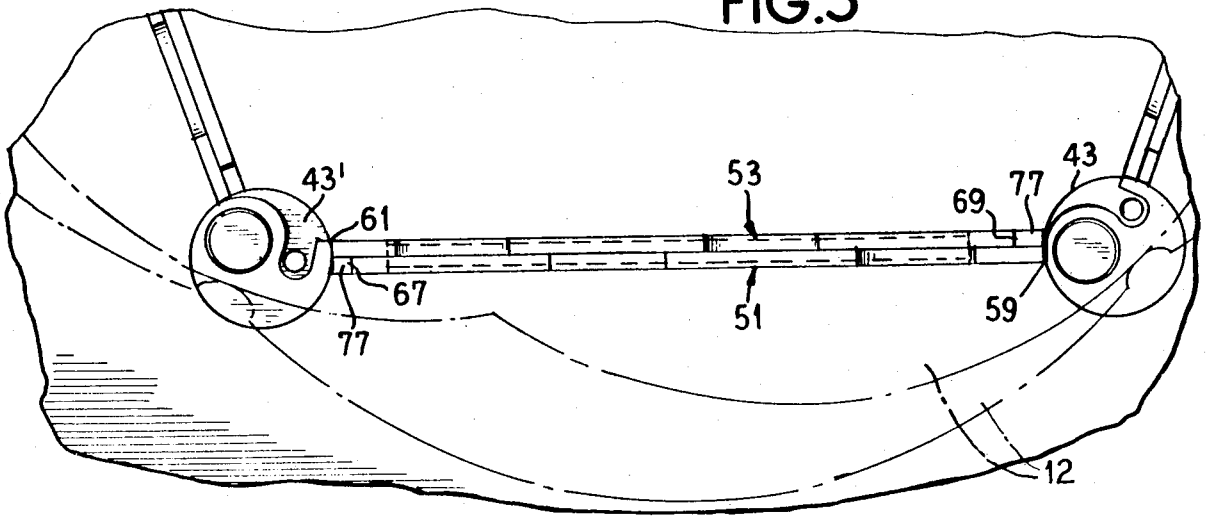
FIG. 5 illustrates a top elevational view of the side seals and button seals of the present invention.

Referring now to FIGS. 2 and 4, as illustrated, each side seal 41 includes a pair of identical oppositely disposed seal strips 51 and 53. Each seal strip 51 and 53 includes an elongated body portion 55 and 57 respectively, having a front end 59 and 61, a back end 63 and 65, and a triangular portion 67 and 69, respectively. The term triangular is used broadly here and includes a truncated triangle or other shape resembling a triangle. The back end 63 and 65 of the elongated body 55 and 57 includes a relieved portion 71 and 73, respectively that, has a shape that corresponds to a side of the triangular portion 67 and 69. Accordingly, as illustrated in FIG. 4, when the side seal 41 is disposed between button seals 43 the triangular portion 67 and 69 is received within the relieved portion 71 and 73 of the body member 55 and 57. Preferably, the relieved triangular portion 71 and 73 of the elongated body 55 and 57 is relieved on an angle of approximately 45°.

The seal strips 51 and 53 are identical and oppositely disposed between the button seals 43. Accordingly, the front end 59 of one seal strip 51 abuts a first button seal 43 while the front end 61 of the other seal strip 53 abuts a second button seal 43'. Accordingly, opposite triangular portions 67 and 69 of the seal strips 51 and 53 abut opposite button seals 43 and 43'.

The elongated body portions 55 and 57 also include indentations 75 that have a substantially elongated rectangular construction. Because the seal strips 51 and 53 are oppositely disposed, the indentations 75 are staggered or offset from each other when the seal strips are disposed between the button seals 43 and 43'. Accordingly, an indentation 75 from one seal strip 51 will overlap with a solid portion of the other seal strips 53. The indentations 75 function to reduce the friction drag caused by the side seals 41 on the rotor 12.

The triangular portions 67 and 69 of the seal strips 51 and 53 include a relieved top portion. Accordingly, when the seal strips 51 and 53 are positioned between button seals 43 and 43', the relieved top portion of the triangular portion 67 and 69 defines a gap 77 between the button seal 43, the seal strips 51 and 53, and rotor 12. The gap 77 prevents the triangular portions 67 and 69 from wearing against the rotor 12 thereby improving the efficiency of the piston. Because the seal strips 51 and 53 are oppositely disposed, the gap 77 of one triangular portion 67 overlaps with a solid portion of the other seal strip.

As previously stated, the side seals 41 are spring biased against the rotor 12. To this end, a wave spring 47 is received with the slots 35 in the side wall 37 and baises the side seals 41 outwardly. Although a wave spring is preferably used, other types of springs can be utilized to bias the side seals. Preferably, the triangular portions 67 and 69 include downwardly extending portions 83 and 85. The downwardly extending portions 83 and 85 cooperate to prevent the wave spring 47 from having unrestricted lateral movement relative to the seal strips 51 and 53. This ensures that the side seals 41 are biased outwardly.

The button seals 43 are also spring biased away from the housing against the rotor 12. To this end, the aperture 44 in the side wall 37 that receives the button seals 43 also receives a spring 49. The spring 49 biases the button seal 43 outwardly against the rotor 12. To this end, the spring 49 surrounds a plug 89 disposed in the aperture 44 and biases the button seal 43 outwardly.

In order to reduce the frictional drag on the rotor 12 from the button seals 41, and thereby improve the efficiency of the trochoidal rotor assembly, the button seals 43 include a relieved area 91.

Figure 6:
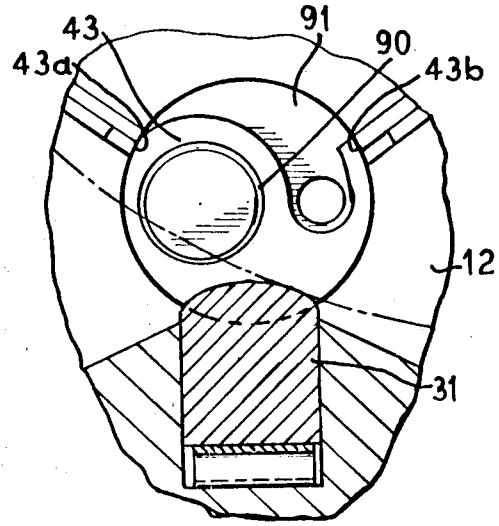
FIG. 6 illustrates an embodiment of the button seal of the present invention.

In the embodiment illustrated in FIG. 6, the button seal 43 has a circular cross-sectional profile and has a swathlike relieve portion 91. It has been found that the relieved portion 91 is not needed to provide a sufficiently strong seal between the button seal 43, rotor 12, and apex seal 31. Due to the reduced surface area of the button seal 43 the spring pressure on the button seal can be reduced while still maintaining a given pressure, i.e., pounds per square inch. Accordingly, the frictional drag of the button seal 43 on the rotor 12 is reduced. Moreover, preferably the area 90 of the button seal 43 where the plug 87 is received is also relieved. Furthermore, the plug 89 is loosely situated in the aperture in the button seal 43 so that any trapped air leaking into the face of the plug area will force the plug against the end wall and not cause additional drag on the rotor.

Due to the swath-like relieved area 91 the button seal 43 also affords a sufficient seal with the side seals 41. To this end, one side seal 41 abuts a portion 43*a* of the button seal 143 and the other side seal abuts an extended perimeter portion 43*b* of the button seal. Accordingly, the swath-like relieved area 91 of the button seal 43 reduces the frictional drag on the rotor yet affords a seal grid with the side seals 41.

Figure 7:
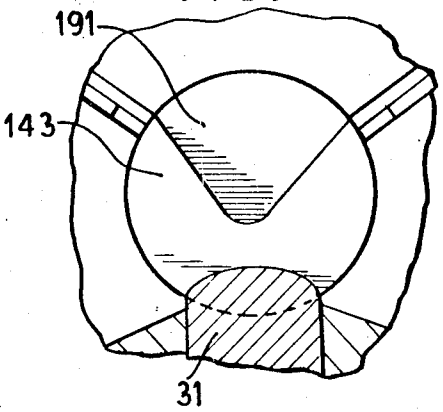
FIG. 7 illustrates another embodiment of the button seal of the present invention.

In the embodiment illustrated in FIG. 7, the button seal 43 has a circular cross-sectional profile and a relieved circular arc area 191 on the rotor side of the button seal. It has also been found that the relieved arc area 191 is not needed to provide a sufficiently strong seal between the button seal 143 and the rotor and apex seals 31. Preferably, an 80° arc is relieved on the button seal 143. Accordingly, by relieving the arc portion 191 of the button seal 143, the spring pressure on the button seal can be reduced while still maintaining the needed pressure, i.e., pounds per square inch, and therefore the frictional drag on the rotor is correspondingly reduced. Indeed, it has been found in an outer envelope trochoidal device having four lobes, and thereby ten (10) button seals 143 with an 80° arc relieved portion 191, that the resultant reduction in the frictional drag on the rotor results in a work efficiency increase of approximately 3%.

It has been found that in both preferred embodiments of the button seals 43 and 143 the relieved area can be relieved by only approximately 1/32 of an inch and still afford a reduction in frictional drag on the rotor 12.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A seal assembly for a rotor that planetates within a housing of a trochoidal rotary device comprising a series of side seals disposed in side walls in the housing, the side seals being interconnected by button seals disposed in the side walls of the housing between side seals, the side seals and button seals being spring biased outwardly against the rotor, each side seal including a pair of identical oppositely disposed seal strips having an elongated body member and a triangular portion, the elongated body member having a triangular relieved portion having a shape corresponding to a side of the triangular portion, the seal strips being interconnected between two button seals so that the triangular portion of a first seal strip abuts a first button seal and the triangular portion of a second seal strip abuts the second button seal, the button seal including a relieved area on a rotor side of the button seal.

2. The seal assembly of claim 1 wherein each triangular portion includes a relieved portion, the relieved portion defining a gap between the button seal, the elongated body member, and the rotor.

3. The seal assembly of claim 1 wherein the elongated body member includes a plurality of indentations, the seal strips being disposed oppositely so that the indentations of the first seal strip do not overlap with the indentations of the second seal strip.

4. The seal assembly of claim 1 wherein the button seal has a swath-like relieved area.

5. The seal assembly of claim 1 wherein the side seals are biased against the rotor by wave springs and the triangular portion includes a portion that extends from a bottom end of the triangular portion that restricts the movement of the wave spring.

6. The seal assembly of claim 1 wherein the button seal has a cross-sectional circular profile having a relieved area of approximately 80° of the circular arc of the cross-sectional profile of the button seal.

7. A seal assembly for a rotor that planetates within a housing of a trochoidal rotary device comprising a series of side seals interconnected by a plurality of button seals, the side seals and button seals being disposed in side walls in the housing, the button seals being spring biased outwardly from the side walls and including a substantially circular cross-section that includes a relieved swath-like area, disposed within an aperture of the button seal is a plug that is surrounded at least in part by a spring, the button seal including a relieved area under the plug.

8. The seal assembly of claim 7 wherein the side seals includes a pair of identical oppositely disposed seal strips having an elongated body member and a triangular portion, the elongated body member having a triangular relieved portion having a shape corresponding to a side of the triangular portion, the seal strips being interconnected between two button seals so that the triangular portion of a first seal strip abuts a first button seal and the triangular portion of a second seal strip abuts a second button seal.

9. The seal assembly of claim 8 wherein each body member of the seal strips includes at least one indentation.

10. A seal assembly for an outer envelope trochoidal rotary device having a rotor that planetates around a housing comprising:

a plurality of button seals disposed in apertures in side walls in the housing and being spring biased outwardly against a portion of the rotor;

a series of side seals interconnected by the button seals, the side seals being disposed in the side walls of the housing, each side seal including two identical oppositely disposed segments, each segment having an elongated body portion and a triangular portion, the elongated body portions having a relieved angular portion at an end that corresponds to a side of the triangular portion, each side seal being located between two button seals with a first triangular portion abutting one button seal and a second triangular portion abutting a second button seal, the triangular portions including a relieved top portion, the button seal, triangular portion, and elongated body cooperating to define a gap at the relieved top portion; and the button seal having a circular cross-sectional profile that includes a relieved area on a rotor side of the button seal.

11. The seal assembly of claim 10 wherein:

the side seals are baised outwardly by wave springs; and the triangular portions include extending portions that extend from a bottom end of the triangular portion the extending portions of the triangular portion cooperating to prevent unrestricted lateral movement of the wave spring with respect to the side seals.

12. The seal assembly of claim 10 wherein the relieved area of the button seal has a swath-like shape.

13. The seal assembly of claim 10 wherein the relieved area of the button seal defines a circular arc of approximately 80°.

14. The seal assembly of claim 10 wherein the button seal includes a plug disposed in an aperture therein.

15. The seal assembly of claim 10 wherein the body portions of the side seals include a plurality of indentations in a top portion thereof.

16. The seal assembly of claim 15 wherein the indentations of a first segment do not overlap with the indentations of a second segment.

* * * * *